US005706766A

United States Patent [19]

Koehler et al.

[11] Patent Number: 5,706,766

[45] Date of Patent: Jan. 13, 1998

[54] METHOD OF OPERATING A ONCE-THROUGH STEAM GENERATOR AND A CORRESPONDING STEAM GENERATOR

[75] Inventors: Wolfgang Koehler, Kalchreuth; Eberhard Wittchow, Erlangen, both of Germany

[73] Assignee: Siemens Aktiengesellschaft, Munich, Germany

[21] Appl. No.: 627,779

[22] Filed: Apr. 1, 1996

Related U.S. Application Data

[63] Continuation of PCT/DE94/01086 Sep. 19, 1994.

[30] Foreign Application Priority Data

Sep. 30, 1993 [DE] Germany ..... 43 33 404.0

[51] Int. Cl.[6] ..... F22B 37/12

[52] U.S. Cl. ..... 122/6 A; 122/451 S; 122/235.14

[58] Field of Search ..... 122/6 A, 235.11, 122/235.14, 235.15, 235.23, 406.4, 451 S

[56] References Cited

U.S. PATENT DOCUMENTS

| | | | |
|---|---|---|---|
| 4,864,973 | 9/1989 | Lieb et al. | 122/6 A |
| 4,987,862 | 1/1991 | Wittchow et al. | 122/6 A |
| 5,070,937 | 12/1991 | Mougin et al. | 165/133 |

FOREIGN PATENT DOCUMENTS

| | | |
|---|---|---|
| 0503116 A1 | 9/1992 | European Pat. Off. . |
| 1.288.755 | 2/1962 | France . |
| 2032891 | 2/1971 | Germany . |
| 92/18807 | 10/1992 | WIPO . |

OTHER PUBLICATIONS

Japanese Patent Abstract No. 5010696 (Yoshio), dated Jan. 19, 1993.

*Primary Examiner*—Henry A. Bennett
*Assistant Examiner*—Gregory Wilson
*Attorney, Agent, or Firm*—Herbert L. Lerner; Laurence A. Greenberg

[57] ABSTRACT

A once-through steam generator has a vertical flue formed of tubes which are oriented vertically and which are connected in parallel for guiding a flow of flow medium therethrough. The tubes have a surface structure on an inner wall surface which causes flow turbulence and eddy currents in the flow medium. The surface structure includes first and second, mutually superimposed, contrary ribbings. The first ribbing encloses an acute angle with the tube axis, and the second ribbing extends parallel to the tube axis. The first ribbing forms an onflow flank angle with the tube wall which is flatter than a flow-off flank angle. Elevations of the ribbings rise at least 0.7 mm above the tube wall surface. A mass flow density of the medium in the tubes is adjusted as a function of the inner tube diameter, by maintaining the mass flow density below a predetermined limit curve.

3 Claims, 5 Drawing Sheets

METHOD OF OPERATING A ONCE-THROUGH STEAM GENERATOR AND A CORRESPONDING STEAM GENERATOR

CROSS-REFERENCE TO RELATED APPLICATION

This application is a continuation of our international application PCT/DE94/01086, filed Sep. 19, 1994, which designated the United States.

BACKGROUND OF THE INVENTION

1. Field of the Invention

The invention relates to a continuous steam generator, also referred to as a once-through steam generator, which has a gas flue of substantially vertically oriented pipes welded together in gas-tight fashion. The invention also relates to a method of operating a continuous steam generator of this type.

A steam generator whose combustion chamber wall is made up of vertically arranged tubes can be made more cost-effectively than a steam generator with helical tubing. However, the unavoidable differences in the heat exchange and heat delivery to the individual tubes can lead to temperature differences between adjacent tubes. This is particularly true at the outlet of an evaporator. These temperature differences can cause damage from excessive thermal strains. The temperature differences can be avoided by drastically reducing the pressure loss attributable to friction. The reduction is attained in turn by a corresponding reduction in the flow velocity, or in other words the mass flow density in the tubes.

2. Description of the Related Art

Improved heat transfer even at a low mass flow density can be achieved in accordance with the disclosure in European patent publication No. 0 503 116. Tubes are used therein with ribs on their inside which form a multiple thread.

Furthermore, German published patent application 20 32 891 discloses cross-drawn tubes, with a surface structure formed on the inside wall formed of a first ribbing and an opposed second ribbing superimposed on the first ribbing.

In a tubing of the combustion chamber wall of a steam generator with internally ribbed evaporator tubes, the axial flow has a swirl superimposed on it that leads to a phase separation of the flow medium or heat-absorbing medium with a water film on the inner wall of the tube, that is, on the heating surface. As a result, the very good heat transfer occurring during boiling can be maintained until virtually all the water has evaporated. In the pressure range between 200 bar and 221 bar (20.0–22.1 MPa), however, excessively high wall temperatures cannot always be avoided by means of a swirl flow alone, when strong heating takes place. In the vicinity of the critical pressure at approximately 210 bar (21 MPa)—where there is only a slight difference in density between the liquid and the vapor phase—the wetting of the heating surface is substantially more difficult to assure than in a pressure range below 200 bar. This is because a vapor film forming between the tube wall and the liquid phase of the heat-absorbing medium impedes the heat transfer (film boiling). In this region of steam-film formation, the temperature of the tube wall rises sharply. As described in the article "Verdampferkonzepte füur Benson-Dampferzeuger" [Evaporator Concepts for Benson Steam Generators] by J. Franke, W. Köhler and E. Wittchow, published in VGB Kraftwerkstechnik 73 (1993), No. 4, pp. 352–360, above a pressure of around 210 bar even slight wall overheating is sufficient to change from the boiling state with a wetted heating surface to film boiling with an unwetted heating surface. In the aforementioned pressure range, vapor bubbles can form in the superheated boundary layer, even at slight overheating, and combine to form large bubbles and thus impede heat transfer (homogeneous nucleation).

The heat transfer mechanism described means that in the aforementioned tubes of steam generators, which are operated at pressures of about 200 bar and above, the mass flow density and thus the pressure loss attributable to friction must be selected to be higher than in the case of steam generators that are operated at pressures below 200 bar. Particularly in the case of small inner diameters of tubes, the advantage that the throughput increases when individual tubes are heated to a greater extent is lost. However, since high steam pressures of over 200 bar are needed in order to achieve high thermal efficiency and hence low carbon dioxide emissions, it is necessary to assure a good heat transfer in this pressure range as well. Steam generators with a vertically tubed combustion chamber wall are therefore conventionally operated with relatively high mass flow densities in the tubes, so that in the critical pressure range of about 200 to 221 bar, an adequately high heat transfer from the tube wall to the heat-absorbing medium, that is, the water/steam mixture, can be attained. However, when heating is variable, the result is only unsatisfactory temperature compensation at the outlet of the tubes.

SUMMARY OF THE INVENTION

It is accordingly an object of the invention to provide a method of operating a once-through steam generator and a corresponding steam generator, which overcomes the above-mentioned disadvantages of the heretofore-known devices and methods of this general type. The primary object of the invention is to disclose a continuous steam generator with evaporator tubes that provide for especially good heat transfer from the tube wall, i.e. the heating surface, to the heat-absorbing medium is assured, even in the vicinity of the critical pressure of about 210 bar. A method of operating such a continuous steam generator is also to be disclosed, with which low temperature differences at the outlet of adjacent steam generator tubes are attained.

With the above and other objects in view there is provided, in accordance with the invention, a once-through steam generator, comprising:

a vertical gas flue formed of a plurality of tubes, the tubes being welded to one another in a gas-tight manner, and burners for fossil fuel disposed at the tubes;

the plurality of tubes being oriented substantially vertically and being connected in parallel for guiding a flow of flow medium therethrough;

the tubes each having a longitudinal axis and a wall with an inner wall surface, and a surface structure formed on the inner wall surface for causing flow turbulence in the flow medium;

the surface structure on the inner wall surface including first and second, mutually superimposed, contrary ribbings, the first ribbing forming an acute angle with the tube axis, and the second ribbing extending substantially parallel to the tube axis; and the first ribbing forming an onflow flank angle and a flow-off flank angle with the tube wall, the onflow flank angle being flatter than the flow-off flank angle.

In other words, the surface structure on the inner wall surface of the tubes is provided for the purpose of achieving high flow turbulence and/or to develop longitudinal eddies in the flow medium. The surface structure includes two superimposed, contrary riflings and the tubes are connected in parallel for the flow therethrough of the flow medium. The first rifling forms an acute angle with the tube axis, and the second rifling (the counter ribbing) extends parallel to the tube axis. The objects of the invention are satisfied with the invention in that a flank angle formed by the first rifling (a helical ribbing) and the tube wall is flatter on the onflow side, which faces against the incoming medium flow, than on the flow-off side.

The evaporator tube then, in a simple manner in terms of manufacture, has a helical inner ribbing with longitudinal grooves that interrupt the ribs. The longitudinal grooves predetermine breakaway edges that promote eddy generation; the creation of longitudinal eddies is promoted especially advantageously by the different flank angles.

The elevations on the inner wall defined by the ribbing are advantageously at least 0.7 mm.

In terms of the novel method of operating such a once-through steam generator, the object of the invention is attained in that the mass flow density $\dot{m}$ in the tubes—in terms of full-load operation, i.e., at 100% steam-generating capacity—is adjusted as a function of the tube ID (inner diameter d). An operating point determined by a pair of values of the mass flow density $\dot{m}$ and the tube inner diameter d lies in a coordinate system between a curve B and the abscissa, and operating points in accordance with the following pairs of values are located on the curve B:

$d_1$=10 mm at $\dot{m}_1$=1300 kg/m$^2$·s $d_2$=25 mm at $\dot{m}_2$=1600 kg/m$^2$·s $d_3$=40 mm at $\dot{m}_3$=1600 kg/m$^2$·s As a result, in addition to a flow swirl, good mixing of the flow is also brought about. Wall overheating can be avoided as a result. Moreover, because of high turbulence in the flow, it is also possible to prevent the formation of such large vapor bubbles at the heating face or in the superheated boundary layer that the bubbles can combine to form a steam film and thus impair the heat transfer.

The varying configuration of the surface structure on the inside of the evaporator tubes means that the operating points are set in different regions between the curve B and the abscissa in accordance with the pairs of values of the mass flow density $\dot{m}$ and the inner tube diameter d.

Other features which are considered as characteristic for the invention are set forth in the appended claims.

Although the invention is illustrated and described herein as embodied in a method of operating a once-through steam generator and a corresponding steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE INVENTION

DESCRIPTION OF THE PREFERRED EMBODIMENTS

Figure 1:
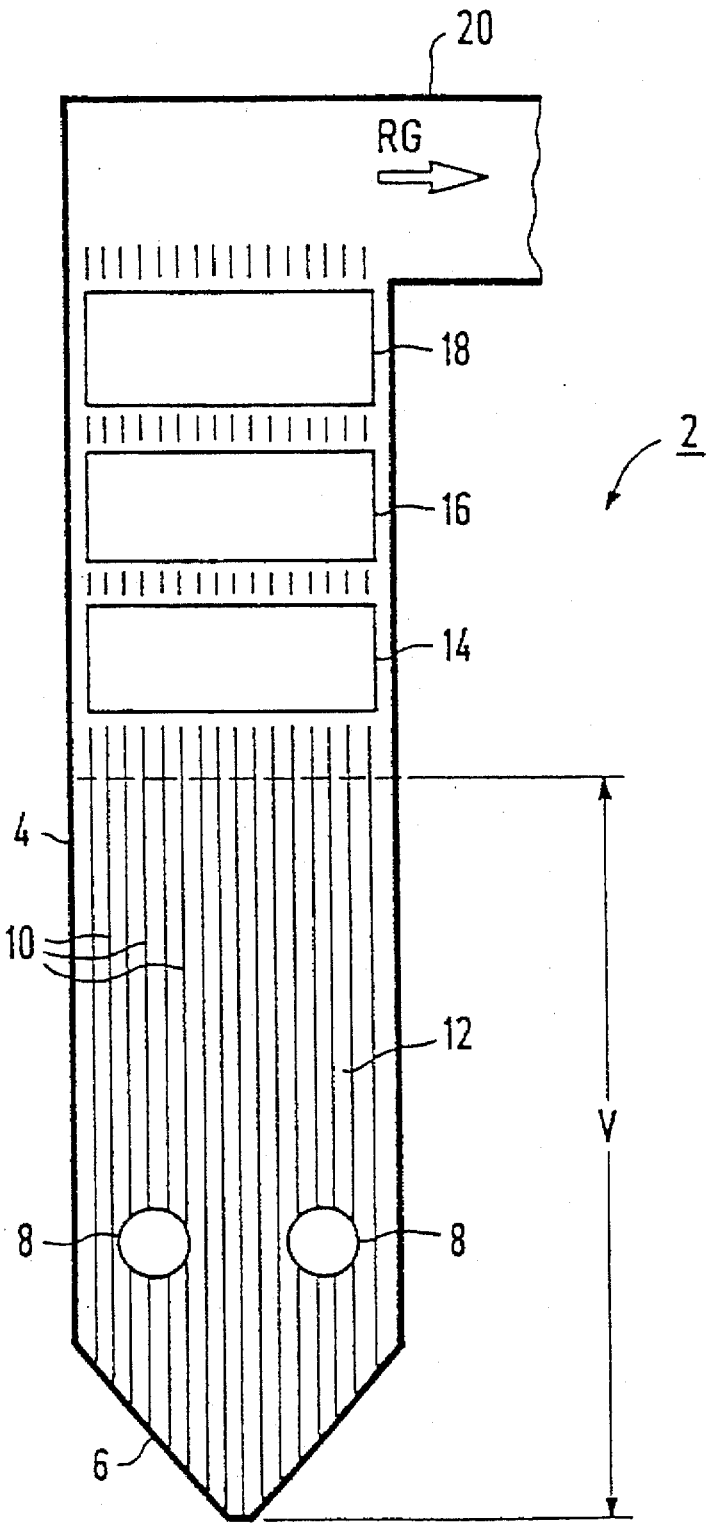
FIG. 1 is a schematic illustration of a steam generator with a vertically tubed combustion chamber wall.

Referring now to the figures of the drawing in detail and first, particularly, to FIG. 1 thereof, there is shown a diagram of a continuous-flow (once-through) steam generator 2 of rectangular cross-section. A vertical gas flue of the steam generator 2 is formed by a containment wall 4 which merges at the lower end into a funnel-shaped bottom 6.

Figure 2:
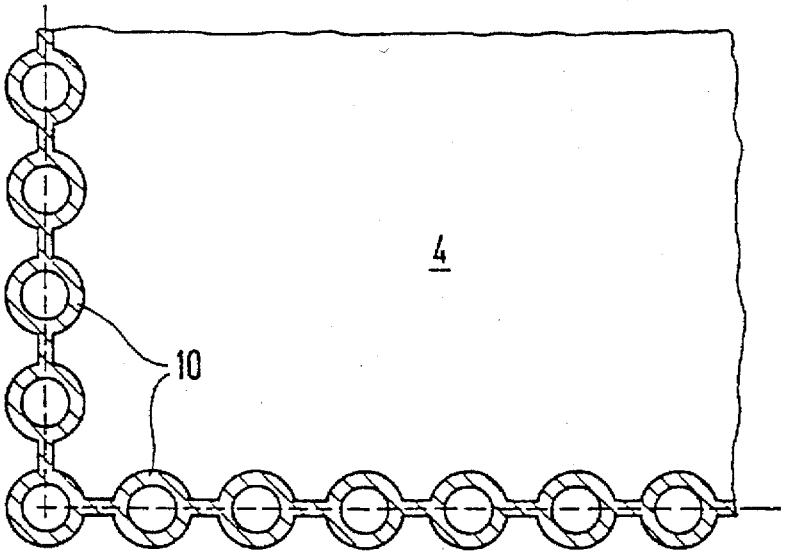
FIG. 2 shows a detail of a horizontal section through a vertical gas flue.
Figure 3:
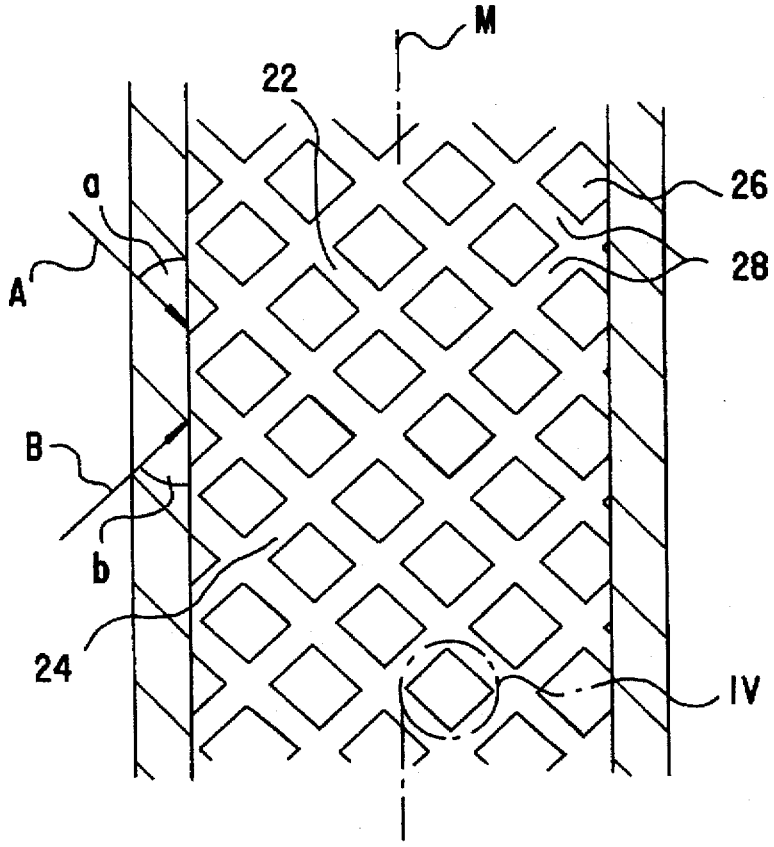
FIG. 3 shows a longitudinal section through a small detail of a steam generator tube with contrary inner ribbings.
Figure 5:
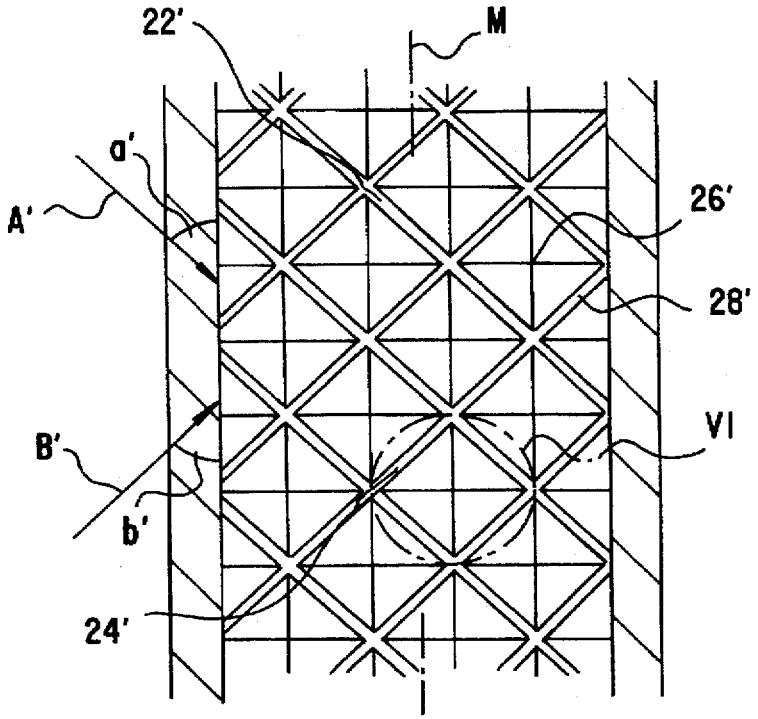
FIG. 5 is a view similar to FIG. 3 of another exemplary embodiment of a steam generator tube with contrary inner ribbings.
Figure 7:
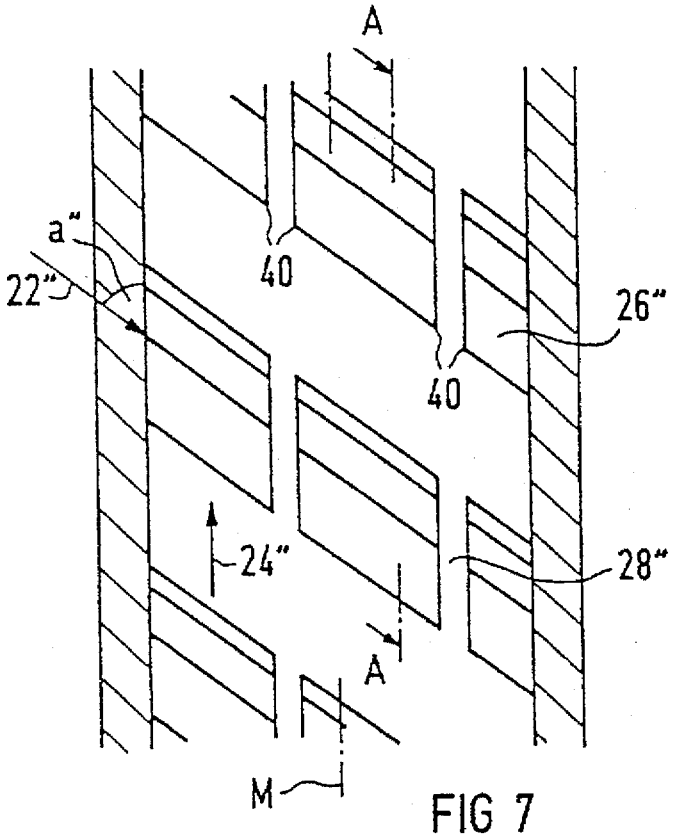
FIG. 7 is a view similar to FIG. 3 of a further exemplary embodiment of a steam-generator tube having oppositely directed inner ribbings.

In a lower region V of the gas flue, there are mounted a plurality of burners for a fossil fuel, each in an orifice 8, of which only two can be seen, in the containment or combustion-chamber wall 4 composed of steam-generator tubes 10 according to FIG. 3, 5 or 7. The steam-generator tubes 10 are arranged to run vertically in this region V, in which they are welded (FIG. 2) to one another in a gas-tight manner to form an evaporator heating surface 12. The tubes 10 welded to one another in a gas-tight manner form the gas-tight combustion-chamber wall 4, for example in a tube/web/tube construction or in a finned-tube construction.

Convection-heating surfaces 14, 16 and 18 are located above this region V of the gas flue. Located above these is a smoke-gas outlet channel 20, via which the flue gas RG generated as a result of the combustion of a fossil fuel leaves the vertical gas flue. The flue gas serves as a heating medium for the water or water/steam mixture flowing in the steam-generator tubes 10.

Figure 4:
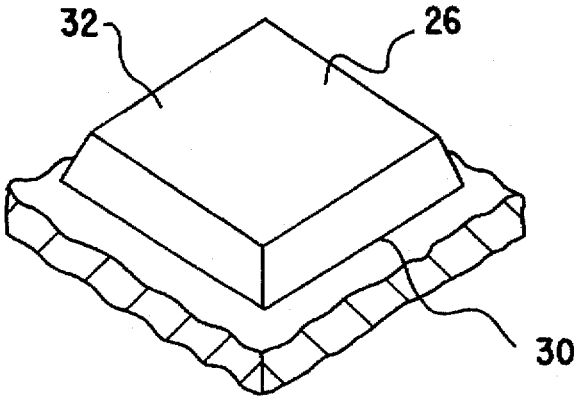
FIG. 4 is a perspective view of a detail IV of FIG. 3 on a larger scale.

The steam-generator tubes 10 have a surface structure on their inside. Referring now to FIG. 3, the steam-generator tube 10 is provided on its inside with a first rifling or ribbing 22, in the direction of the arrow A, on which an oppositely directed second rifling or ribbing 24, in the direction of the arrow B, is superposed. The mutually oppositely oriented ribbings 22 and 24, which form identical acute angles a and b with a tube axis M, result, on the inside, in a regular structure with elevations 26 on lozenge-shaped base surfaces and depressions 28. Such an elevation with a lozenge-shaped base surface 30 and with a flattened topside 32 is shown enlarged in FIG. 4.

Figure 6:
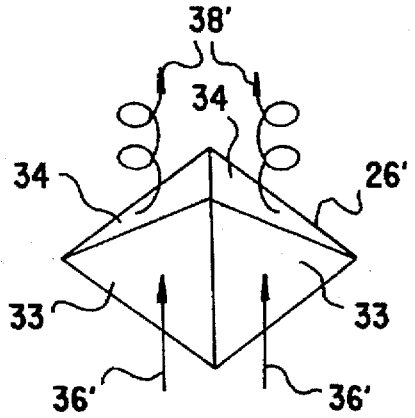
FIG. 6 is a view similar to FIG. 4 of a detail VI of FIG. 5 on a larger scale showing a pyramidal elevation.

In the exemplary embodiment according to FIG. 5 too, the superposed ribbings 22' and 24', in the direction of arrows A' and B' respectively, form identical acute angles a' and b' with the tube axis M. The depressions 28' are wedge-shaped, so that the elevations 26' are pyramidal, as can be seen in the enlarged cutout VI according to FIG. 6. Oblique surfaces 33 and 34, are thus obtained both on the onflow side (facing into the onflowing medium) and on the flow-off side (facing in the direction of medium flow). In particular, as indicated by the arrows 36' and 38', surfaces 33, 34 over which the flow passes at a specific angle tend, when the flow passes over them, to form longitudinal eddies in the wake. This leads to superior intermixing of the boundary layer (running directly along the inner wall) with the core or main flow of the water/steam mixture flowing through the steam-generator tube 10.

In the exemplary embodiment according to FIG. 7, the steam-generator tube 10 has, in addition to a helical inner ribbing 22", longitudinal grooves as depressions 28". The first ribbing 22" in turn forms an acute angle a" with the tube axis M, while the second ribbing 24" runs parallel to the tube axis M. Breakaway edges 40 conducive to the generation of eddies are defined by the longitudinal grooves or depressions 28".

Figure 8:
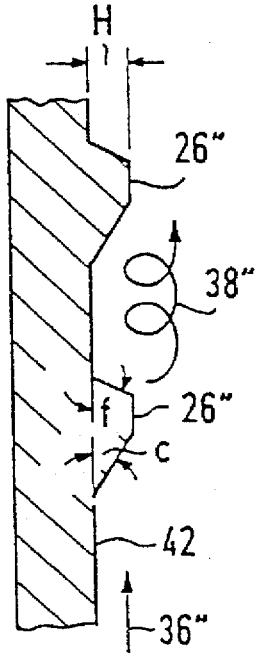
FIG. 8 is a longitudinal section taken along the line A—A in FIG. 7, on a larger scale with elevations.

As shown in the enlarged section A—A of FIG. 8, the elevations 26" of the helical ribbing 22" form an onflow flank angle c with the inner tube wall 42 on the onflow side and a flow-off flank angle f on the flow-off side. At the same time, the flank angle c on the onflow side flatter (smaller) than or equal to the flow-off flank angle f on the flowoff side. This is beneficial to the formation of the longitudinal eddies on the flow-off side, as indicated by the arrows 36" and 38".

The heat generated as a result of combustion of a fossil fuel in the burners of the combustion-chamber wall 4 is absorbed by the water or water/steam mixture (flow medium or heat-absorbing medium) which flows through the tubes 10 and which at the same time evaporates. The elevations 26, 26', 26" project at least by H=0.7 mm into the tube 10, in order to achieve the desired intermixing and/or eddifying of the water fraction and of the steam fraction of the flow medium and consequently a high turbulence within the tube 10. As a result, the tube 10 transfers the heat absorbed by it from the flue gas RG to the flow medium especially effectively and it is cooled reliably. In the case of a surface structure on the inside of the tube 10 according to the exemplary embodiment of FIG. 7, an additional swirl is superimposed on the turbulence.

In order to guarantee low temperature differences at the outlet of adjacent, varyingly heated steam-generator tubes, according to the invention the mass flow density $\dot{m}$ is selected in dependence on the inner tube diameter d. The mass flow density $\dot{m}$ is the averaged throughput per unit area and time (kg/m$^2$·s) of all the tubes 10 in full-load operation, that is to say at 100% steam-generating capacity.

Figure 9:
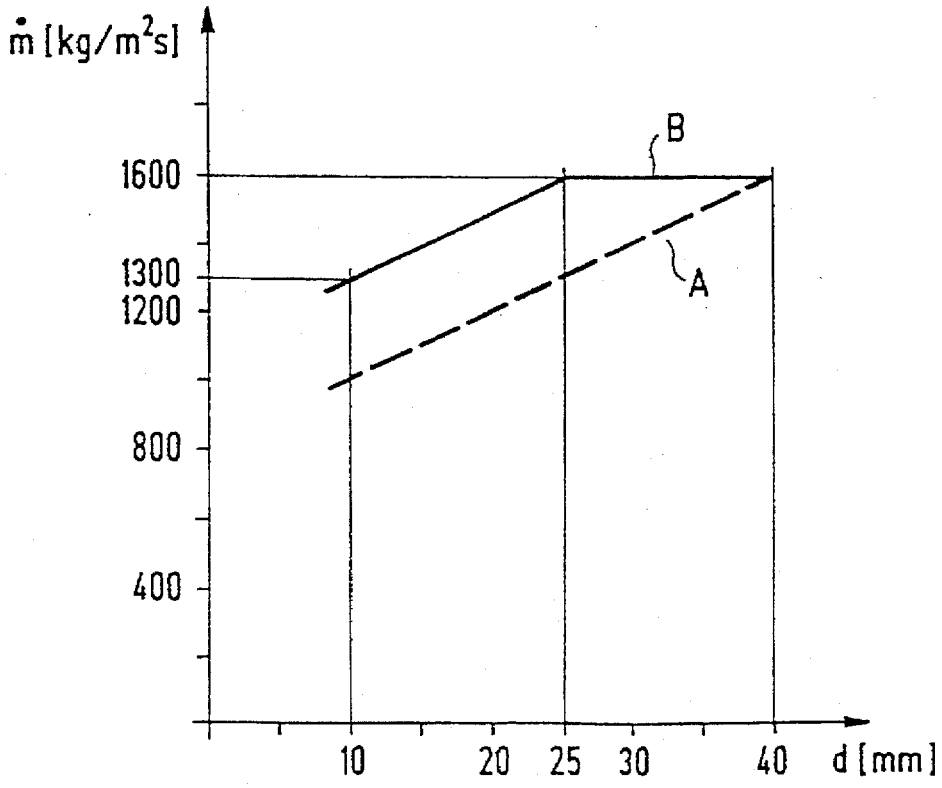
FIG. 9 is a diagram in a cartesian coordinate system of the mass flow density over the tube ID with curves A and B.

In the system of coordinates according to FIG. 9, the mass flow density $\dot{m}$ can be represented as a function of the inner tube diameter d. Three points on the curve B are given by the pairs of values $d_1$=10 mm at $\dot{m}_1$=1300 kg/m$^2$·s $d_2$=25 mm at $\dot{m}_2$=1600 kg/m$^2$·s $d_3$=40 mm at $\dot{m}_3$=1600 kg/m$^2$·s.

Each point in the area located between the curve B and the abscissa, along which the inner tube diameter d is plotted, represents a pair of values (d/$\dot{m}$), in which, when an individual tube 10 is heated to a greater extent, the mass throughput or mass flow through this tube 10 rises or falls only so little that the temperature difference between adjacent tubes remains low. In particular, for the purpose of compensating for the heating of an individual tube 10 to a greater extent, it is necessary that the mass flow in the tube heated to a greater extent rises in relation to the mass flow in tubes with average heating. This is the case in the parallel-tube system considered here, determined by the vertical orientation of the tubes 10, when the following equation is satisfied:

$$\left[\frac{\Delta(\Delta p_{tot})}{\Delta Q}\right]_{M=const.} = \left[\frac{\Delta(\Delta p_R + \Delta p_G + \Delta p_B)}{\Delta Q}\right]_{M=const.} < 0$$

In other words, the total pressure drop $\Delta p_{tot}$ (this is the difference between the pressure in the lower inlet header (inlet manifold) and the pressure in the upper outlet header (outlet manifold) or in an intermediate header) of the tube 10 under consideration must decrease in the event of greater heating ΔQ if the throughput M is kept constant. M having the unit [kg/s] is the mass flow through the tube 10. At the same time, the partial $\Delta p_R$ is the pressure drop attributable to friction, the partial $\Delta p_G$ is the pressure drop as a result of the change in geodetic height, and the partial $\Delta p_B$ is the pressure drop as a result of the acceleration of the flow, the latter partial $\Delta p_B$ being negligible in relation to the other two partials $\Delta p_R$ and $\Delta p_G$. In order to obtain a rise of the mass flow in the tube 10 heated to a greater extent, it is therefore necessary that, with the mass flow M kept constant, the rise of the pressure drop attributable to friction $\Delta p_R$ associated with greater heating is lower than the reduction in the geodetic pressure drop $\Delta p_G$ caused by the greater heating. Since the pressure drop attributable to friction $\Delta p_R$ is proportional to the reciprocal value of the inner tube diameter d, this condition applies to a smaller range of the mass flow density $\dot{m}$ in the tubes 10 in the case of small inner tube diameters d than in the case of tubes 10 with a larger inner tube diameter d. The broken line curve A in FIG. 9 shows this relation.

If the mass flow density $\dot{m}$ in the tubes 10 is below the curve A represented in FIG. 9, on the one hand the mass flow increases in tubes heated to a greater extent in relation to the value in tubes 10 with average heating. On the other hand, a minimum mass flow in the tubes 10 is necessary for the reliable cooling of the tubes 10. Consequently, if the mass flow in the tubes 10 is selected so that the full-load operating point is set above the curve A, then the mass flow in the tubes 10 heated to a greater extent will decrease in relation to that in tubes 10 with average heating. If this decrease is low, then the temperature differences between adjacent tubes also become low. This occurs when the percentage change in mass flow caused by greater heating of a tube 10 amounts to only a fraction of the percentage of the greater heating of this tube 10. Curve B in FIG. 9 reproduces the trend of the mass flow density $\dot{m}$ which is possible in this context.

For operating points selected below the curve A, i.e., between the curve A and the abscissa, it is guaranteed that the mass flow of tubes 10 heated to a greater extent rises. For operating points located below the curve B, i.e., between the curve B and the abscissa, the mass flow in the tubes 10 which are heated to a greater extent decreases by no more than 20% of the percentage of greater heating. If, for example, the greater heating of a tube amounts to 10%, then the mass flow in this tube will decrease by less than 2% relative to the value of the tubes 10 with average heating.

In view of the especially good heat-transfer properties of the tubes 10 utilized herein, there is no need to increase the mass flow density above $\dot{m}$=1600 kg/m$_2$·s. The curve B therefore runs horizontally from an inner tube diameter of d=25 mm upwards. Consequently, with a given inner tube diameter d, the mass flow density $\dot{m}$ in the tubes 10 must expediently be selected below the associated maximum value located on the curve B. The disadvantageous consequences of the incorrect heating of individual tubes 10 are thereby avoided.

The afore-mentioned limiting of the mass flow density to $\dot{m}$=1600 kg/m$^2$·s starting at an inner tube diameter of d=25 mm is achieved in an advantageous way by the use of tubes 10 which have an inner surface structure according to the exemplary embodiments shown in FIGS. 3, 5 or 7. The novel surface structure, due to the high flow turbulence caused thereby, greatly improves heat transfer compared to the conditions in smooth tubes.

We claim:

1. A once-through steam generator, comprising:

a vertical gas flue formed of a plurality of tubes, said tubes being welded to one another in a gas-tight manner, and burners for fossil fuel disposed at said tubes;

said plurality of tubes being oriented substantially vertically and being connected in parallel for guiding a flow of flow medium therethrough;

said tubes each having a longitudinal axis and a wall with an inner wall surface, and a surface structure formed on said inner wall surface for causing flow turbulence in the flow medium;

said surface structure on said inner wall surface including first and second, mutually superimposed, contrary ribbings, said first ribbing forming an acute angle with said tube axis, and said second ribbing extending substantially parallel to said tube axis; and said first ribbing forming an onflow flank angle and a flow-off flank angle with said tube wall, said onflow flank angle being flatter than said flow-off flank angle for the formation of longitudinal eddies.

2. The steam generator according to claim 1, wherein said surface structure includes elevations on said tube wall defined by said ribbings, said elevations having a height from said inner wall surface of at least 0.7 mm.

3. A method of operating a continuous steam generator, which comprises:

providing a steam generator with a vertical gas flue formed of a plurality of parallel-connected tubes, and combusting a fossil fuel in burners disposed at said tubes;

providing the tubes with a surface structure on an inner wall surface thereof, and forming the surface structure of first and second, mutually superimposed, contrary ribbings;

guiding a flow medium in parallel flow through the plurality of tubes and adjusting a mass flow density of the medium in the tubes as a function of an inner tube diameter, by determining an operating point with a pair of values of the mass flow density and the inner tube diameter being located in a cartesian coordinate system between the abscissa and a curve containing the following operating points:

$$d_1=10 \text{ mm at } \dot{m}_1=1600 \text{ kg/m}^2\cdot\text{s}$$

$$d_2=25 \text{ mm at } \dot{m}_2=1600 \text{ kg/m}^2\cdot\text{s}$$

$$d_3=40 \text{ mm at } \dot{m}_3=1300 \text{ kg/m}^2\cdot\text{s}$$

where d is the inner tube diameter and $\dot{m}$ is the mass flow density of the flow medium in the tubes.

* * * * *